United States Patent [19]

Wada et al.

[11] Patent Number: 4,482,311

[45] Date of Patent: Nov. 13, 1984

[54] BURNER WITH OXYGEN SHORTAGE SENSOR

[75] Inventors: Chuzoh Wada, Nara; Yoshikazu Matsuda, Sakurai, both of Japan

[73] Assignee: Matsushita Electric Industrial Co., Ltd., Osaka, Japan

[21] Appl. No.: 434,561

[22] Filed: Oct. 15, 1982

[30] Foreign Application Priority Data

| | | | |
|---|---|---|---|
| Oct. 20, 1981 | [JP] | Japan | 56-168395 |
| Nov. 4, 1981 | [JP] | Japan | 56-176868 |
| Dec. 1, 1981 | [JP] | Japan | 56-193881 |
| Dec. 3, 1981 | [JP] | Japan | 56-195191 |
| Dec. 4, 1981 | [JP] | Japan | 56-195919 |

[51] Int. Cl.[3] ..... F23N 5/24

[52] U.S. Cl. ..... 431/15; 431/76; 431/33; 126/96; 340/633

[58] Field of Search ..... 431/75, 78, 6, 12, 13, 431/33, 14, 15, 76; 236/15 E, 94; 62/126, 129; 340/632, 633, 634; 73/23; 126/96

[56] References Cited

U.S. PATENT DOCUMENTS

| | | | |
|---|---|---|---|
| 3,041,590 | 6/1962 | Lucci | 340/633 |
| 3,438,738 | 4/1969 | Johnson | 340/633 X |
| 3,725,895 | 4/1973 | Haynes | 340/632 X |
| 3,973,898 | 8/1976 | Seider | 431/76 |
| 4,238,185 | 12/1980 | Watson | 431/76 |
| 4,319,110 | 3/1982 | Tanabe et al. | 340/634 X |
| 4,319,556 | 3/1982 | Schwartz et al. | 126/77 |
| 4,392,813 | 7/1983 | Tanaka et al. | 431/76 |
| 4,395,226 | 7/1983 | Nakanishi et al. | 431/76 |
| 4,396,370 | 8/1983 | Yamana et al. | 431/76 X |

FOREIGN PATENT DOCUMENTS

| | | | |
|---|---|---|---|
| 241 | 1/1979 | Japan | 431/76 |
| 68528 | 5/1980 | Japan | 431/76 |
| 56527 | 5/1981 | Japan | 431/76 |
| 133533 | 10/1981 | Japan | 431/14 |

*Primary Examiner*—Samuel Scott
*Assistant Examiner*—Carl D. Price
*Attorney, Agent, or Firm*—Stevens, Davis, Miller & Mosher

[57] ABSTRACT

An oxygen shortage sensor is placed in a space defined above a burner unit exposed to the atmosphere. When an oxygen shortage condition is detected by the oxygen shortage sensor, an alarm is raised from an alarm unit or combustion of the burner unit is stopped by a combustion stopper. In such an apparatus, in order to secure a stable oxygen shortage detection by the oxygen shortage sensor, the oxygen shortage sensor is located in a space above the burner unit and in a casing having an opening formed on the side of the burner unit.

3 Claims, 19 Drawing Figures

BURNER WITH OXYGEN SHORTAGE SENSOR

FIELD OF THE INVENTION

The present invention relates to a burner in which an oxygen shortage sensor provided in the upper space of a burner unit exposed to the atmosphere is adapted to detect the lack of oxygen so that when the shortage of oxygen occurs, an alarm is issued from alarm means or the combustion of the burner unit is stopped by combustion stopper means.

BACKGROUND OF THE INVENTION

The perspective view of an ordinary oil stove is shown in FIG. 1 as an example of conventional burners. A reflector 2 is contained in a housing 1, and a burner unit in the form of a combustion cylinder 3 is arranged at the central part of the curved surface of the reflector 2. The combustion cylinder 3 in turn contains a wick by which oil (kerosene) sucked up by capillarity is burned. As a result, the combustion cylinder 3 is red heated, and heat thus generated provides radiation heat or reflection heat in front of the stove by way of the reflector 2 thereby to effect the heating operation. A knob 4 is provided for vertically moving the wick. When the knob 4 is moved upward, a button 5 is depressed to ignite the wick, thereby starting combustion. When the other knob 25 is depressed downward, the knob 4 is disengaged and is restored to the original position. At the same time, the wick in the combustion cylinder 3 lowers to thereby extinguish the fire.

The oil stove of this construction consumes oxygen in the working environment. If oxygen is in short supply, the oxygen concentration decreases slowly so that the lack of oxygen occurs in the combustion cylinder 3 while carbon monoxide increases in amount.

In such a situation, the human body is adversely affected and sufficient ventilation of the room is necessary. The user thus consciously opens the window at predetermined time intervals to take in fresh air. If the user fails to take in fresh air, however, the oxygen concentration is reduced while carbon monoxide increases to cause the dangerous condition called "the lack or shortage of oxygen".

In order to meet such a situation, an oil stove is required in which such a dangerous situation is detected and an alarm is issued by an illuminator 24 used as alarming or warning means or in which the combustion is automatically stopped by combustion stopper means. Such an oil stove is required to include an oxygen shortage sensor for detecting the decrease of oxygen concentration or the increase of carbon monoxide. Various types of oxygen shortage sensors are conceivable. Among them, the most desirable one detects oxygen concentration or oxygen partial pressure or carbon monoxide. Such a sensor detects the shortage of oxygen directly but not indirectly and has the great advantage of high reliability. Nevertheless, the oxygen shortage sensor is incapable of performing the function thereof unless maintained at higher than a predetermined temperature on the one hand and undesirably operates in response to temperature changes on the other hand. The characteristics of an oxygen shortage sensor are shown in FIGS. 2(*a*) and 2(*b*). In the case where the oxygen shortage sensor is made of tin oxide or the like, for example, the resistance value thereof changes with oxygen concentration as shown in FIG. 2(*a*) if the ambient temperature is maintained constant, while the resistance value still continues to change with the change of temperature even when the oxygen concentration is kept substantially constant as shown in FIG. 2(*b*). When the oil stove is provided with the oxygen shortage sensor, therefore, the ambient temperature is required to be maintained substantially constant. Otherwise, an alarm may be falsely issued or combustion may be stopped even when oxygen is not in short supply.

SUMMARY OF THE INVENTION

The object of the present invention is to provide a burner in which oxygen shortage is detected in a stable manner.

In order to achieve this object, according to the present invention, a casing or container is provided in a space above the burner unit and formed with an opening opposing the same and an oxygen shortage sensor is provided in the casing or container.

BRIEF DESCRIPTION OF THE DRAWINGS

The above and other objects, features and advantages will be made apparent by the following detailed description taken in conjunction with the accompanying drawings, in which:

FIG. 12(*b*) is a perspective view of a baffle member thereof;

FIG. 13(*b*) is a perspective view of a baffle member thereof;

FIG. 14(*b*) is a perspective view of a baffle member thereof; and

DETAILED DESCRIPTION OF THE INVENTION

Figure 1:
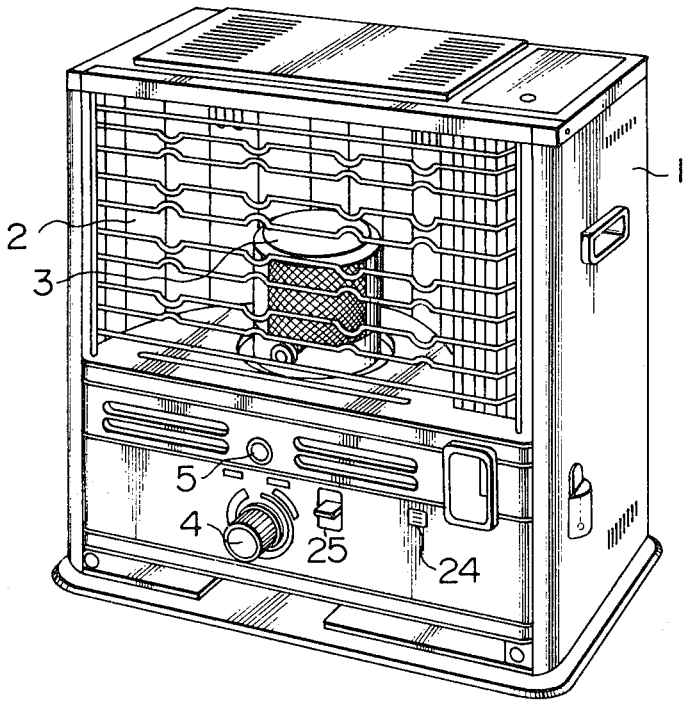
FIG. 1 is a perspective view of an oil stove used as a conventional ordinary burner.
Figure 2A:
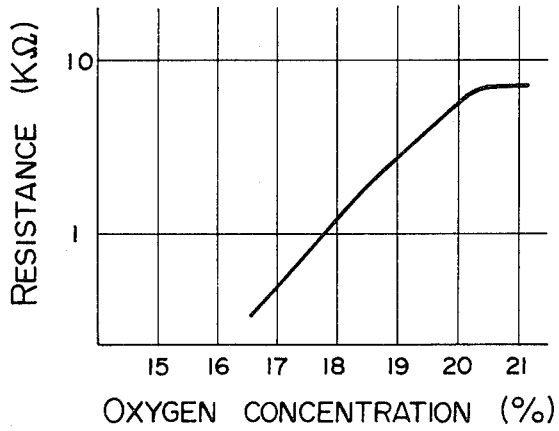
FIGS. 2(*a*) and 2(*b*) show the characteristics of an oxygen shortage sensor.
Figure 2B:
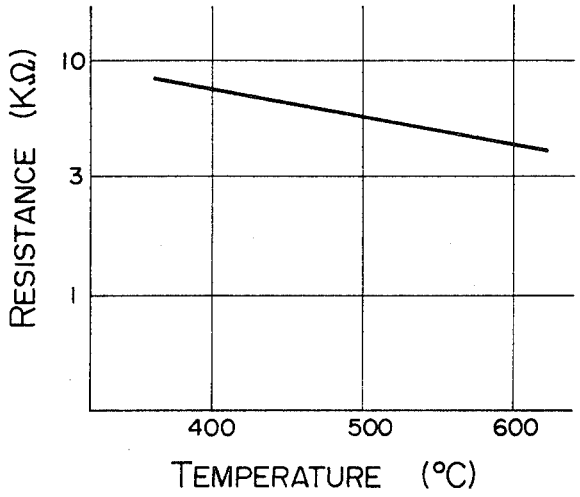
Figure 3:
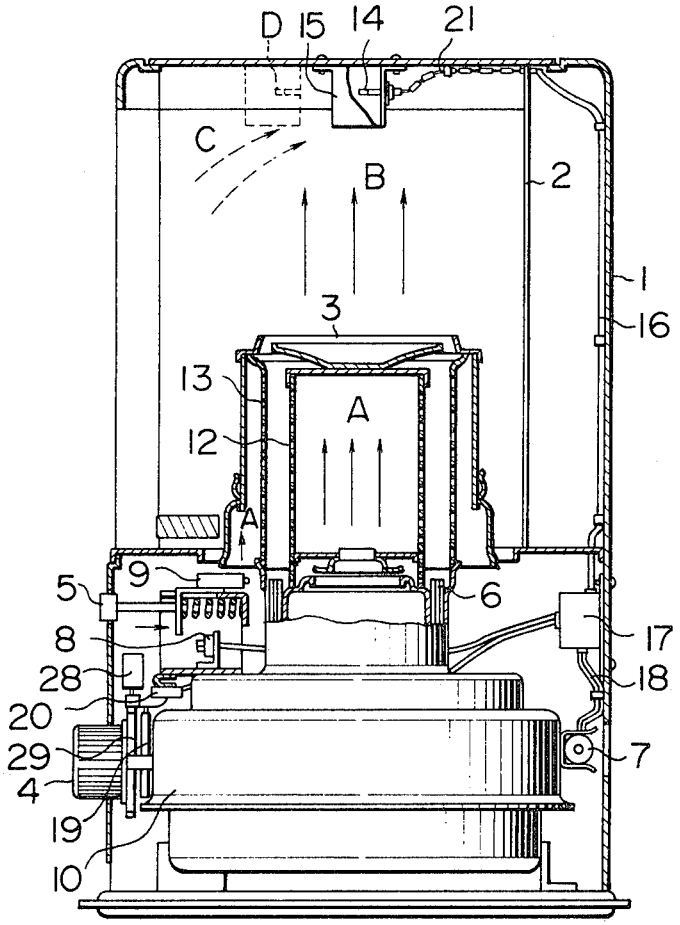
FIG. 3 is a longitudinal sectional view of a burner according to an embodiment of the present invention.

First, reference is made to FIG. 3. A reflector 2 is provided on the rear side of the upper portion of a box-shaped housing 1. A combustion cylinder 3 used as an example of the burner unit is arranged at the central part of the reflector 2. By the rotational operation of the rotary knob 4, a cylindrical wick 6 is movable up and down in the combustion cylinder 3. By depressing an ignition knob 5 when the wick 6 moves up, a battery 7 operatively interlocked therewith applies a voltage through a closed switch 8 to an ignition heater 9 on the one hand, while the ignition heater 9 is interlocked to move toward the wick 6. The wick 6 has already sucked up the oil (kerosene) by capillarity from a fuel tank 10, and therefore the oil can be fired by the ignition heater 9. The combustion cylinder 3 includes an inner flame cylinder 12 and an outer flame cylinder 13. The air A for combustion is supplied into the inner and outer flame cylinders 12 and 13 by draft.

The portable oil stove of this construction comprises a well-known oxygen shortage sensor 14 for detecting the oxygen concentration, partial pressure of oxygen or the concentration of carbon monoxide, which sensor is arranged in a casing provided in the upper space on the center line of the combustion cylinder 3. The lead wire 16 for the sensor 14 is led to a central circuit 17 through a route whose temperature is not raised so high. The control circuit 17 is supplied with a voltage through another lead wire 18 by the battery 7.

When the wick 6 is moved up by turning the rotary knob 4, on the other hand, the cam 19 provided on the same axis as the rotary knob 4 actuates a microswitch 20 in response to the operation of the rotary knob 4. This microswitch 20 is for supplying the voltage of the battery 7 to the whole control circuit 17.

The combustion cylinder 3 is adapted to burn gas supplied from the wick 6 vertically moved by the operation of the rotary knob 4 thereby to discharge the exhaust gas B into the atmosphere upward.

The casing 15 is mounted on the lower side of a roof plate 21 opposite to the combustion cylinder 3.

Figure 4:
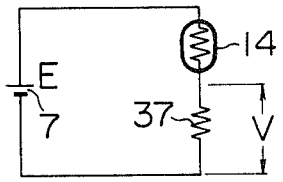
FIG. 4 is a diagram showing a basic electrical circuit of the oxygen shortage sensor of the burner.

In FIG. 4 showing a simple electrical circuit, an oxygen shortage sensor 14 is connected with the battery 7 together with a resistor 37 thereby to obtain a detection output V across the resistor 37. When this detection output V is reduced below a predetermined value, the combustion stops or an alarm is issued.

In this construction, the combustion in the combustion cylinder 3 causes the exhaust gas to move straight upward as shown by the arrow B in FIG. 3 and surrounded the oxygen shortage sensor 14, so that the ambient temperature of the oxygen shortage sensor 14 is maintained substantially constant at 400 °to 600° C., thus indicating a resistance value corresponding to the oxygen concentration.

In the process, the detection output V is provided across the resistor 37 of FIG. 4, and when this detection output V exceeds a predetermined value, the combustion stops or an alarm is issued.

Figure 5:
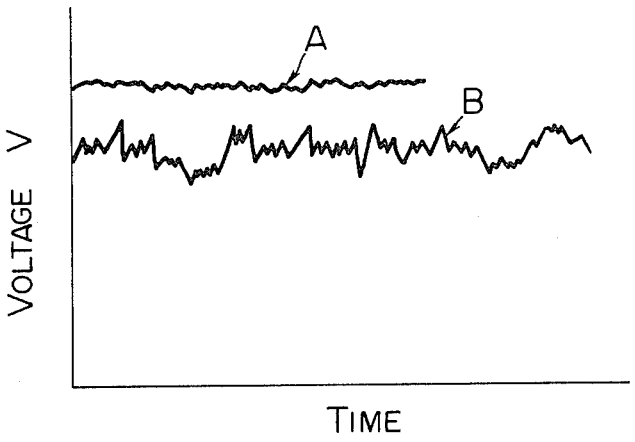
FIG. 5 shows different output characteristics of the oxygen shortage sensor in normal condition located at different places in the burner.

According to the embodiment under consideration, the exhaust gas flows into the casing 15 by way of the lower opening thereof in such a manner as to surround the oxygen shortage sensor 14, and therefore the characteristic thereof is very stable as shown by A in FIG. 5, thus preventing any false actuation.

If the oxygen shortage sensor 14 is arranged at such a position as designated by D in FIG. 3, by contrast, the oxygen shortage sensor 14 is brought into contact with the air C other than the exhaust gas and the temperature thereof is reduced, with the result that as shown by B in FIG. 5, the detection output V is decreased while at the same time undergoing a great change, thus causing a false actuation.

The general operation of the apparatus having the above-described construction will be explained. First, the rotary knob 4 is turned to move up the wick 6. (The wick moved up is shown in FIG. 3) The microswitch 20 is closed by the cam 19 to supply a voltage to the control circuit 17, thus entering the state in which an oxygen shortage can be detected. Under this condition, the button 5 is depressed to bring the ignition heater 9 near to the wick 6 on the one hand and the switch 8 is depressed to ignite the ignition heater 9 by supplying a voltage thereto from the battery 7 on the other hand. When the operator's hand is released from the switch 8 after ignition, the button 5 is restored to the original position. By doing so, the oil (kerosene) gassified from the wick 6 normally burns by securing the combustion air between the inner flame cylinder 12 and the outer flame cylinder 13. The combustion heat is reflected on the reflector 2 to transmit the reflection heat to the front side of the apparatus, while the heat transmitted upward reaches the casing 15 containing the oxygen shortage sensor 14 thereby to store the heat in the casing 15. At the same time, oxygen and carbon monoxide contained in the combustion flame are sent into the casing 15. The oxygen shortage sensor 14 operated normally at the temperatures from 400 °to 600° C. thus monitors the combustion state and applies an output signal thereof to the control circuit 17.

Figure 6:
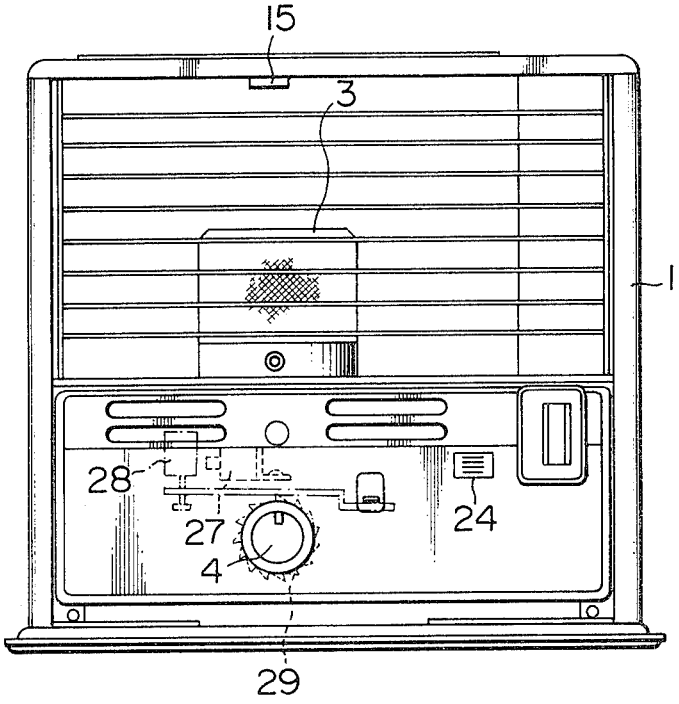
FIG. 6 is a front view of the burner of FIG. 3.
Figure 7:
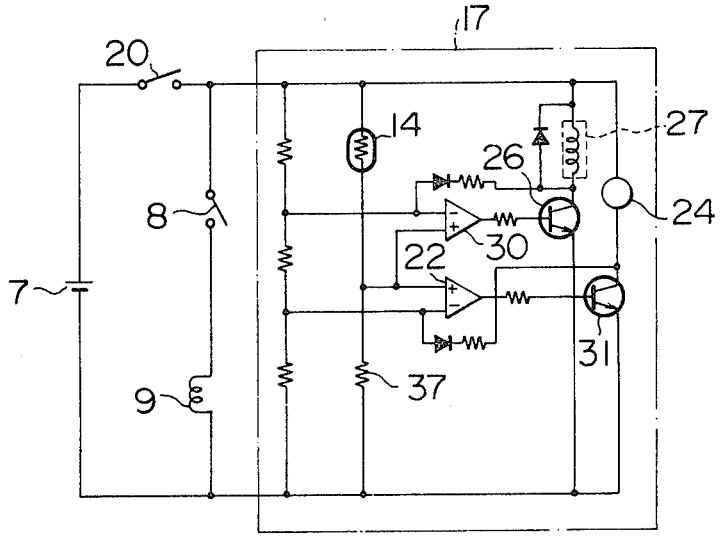
FIG. 7 is a diagram showing an electrical circuit of the burner.

Assume that the amount of oxygen in the air is reduced to about 18%. With increase in the carbon monoxide in the air, the resistance value of the oxygen shortage sensor 14 is reduced and the transistor 31 conducts through the comparator 22 in FIG. 7, so that a buzzer 24 used as an example of alarm means in FIG. 6 issues an alarm. The user then can prevent the oxygen shortage by opening the window or stopping the combustion.

If the user fails to take note of the alarm and the oxygen concentration is futher reduced by 0.5 to 1.0%, then the transistor 26 is turned on through the comparator 30, so that the solenoid 27 is energized. A pendulum 28 (FIGS. 3 and 6) which swings at the time of an earthquake or the like is actuated as if an earthquake has actually occurred, so that the thumb gear 29 is disengaged thereby to restore all the parts to the original position (to the extinguished state with the wick 6 lowered).

Figure 8:
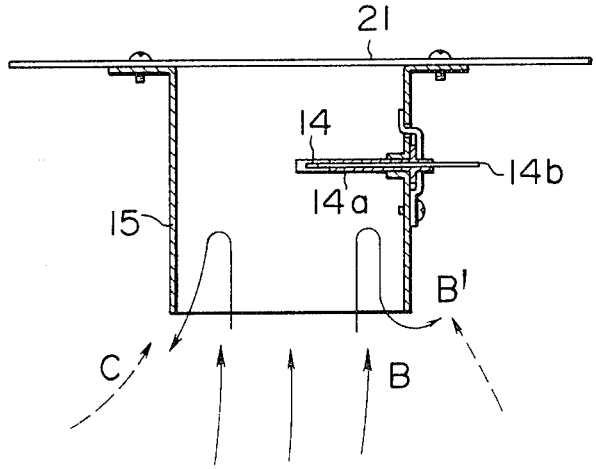
FIG. 8 is an enlarged sectional view of the casing of the burner.

The manner in which the oxygen shortage sensor 14 is contained in the casing 15 is shown in detail in FIG. 8. The oxygen shortage sensor 14 is arranged substantially at the center of the casing 15. The casing 15 has a wall made of a metal material to secure as large a heat capacity as possible.

The casing 15 of this construction is used in order that the combustion gas B of high temperature caused by the combustion flame may maintain a constant ambient temperature of the oxygen shortage sensor 14. If the casing of this type is lacking, the intrusion of external air C will cause a change of the ambient temperature of the oxygen shortage sensor 14, thus causing the false actuation of the sensor 14. Such an inconvenience is substantially prevented by the presence of the casing 15. Especially according to the present embodiment, the maximum size of the lower opening of the casing 15 is smaller than the maximum diameter of the combustion cylinder 3 so that the lower opening of the casing 15 is positioned in the rising flow of the combustion gas B, thereby making it difficult for the air C to intrude into the casing.

The casing 15 is opened only at a part thereof opposed to the combustion cylinder 3 with all the other parts closed, and therefore the combustion gas that has made access as shown by the arrow B is turned for successive air replacements in the manner shown by the arrow B'. This casing 15 is required to be so constructed that the combustion gas is stored for a predetermined length of time and is replaced successively. Thus a through hole, if any, bored in the roof 21 does not pose any problem if it is of such a size as to allow the combustion gas B to be stored for the predetermined length of time. In the casing having no further opening other than the lower opening, the velocity of the combustion gas thus replaced depends on the size of the casing.

Our experiments show that a rectangular casing (which may be replaced by a casing of any other shape such as oval, cylindrical casing with equal effect) with the opening area of 10 to 15 $cm^2$ and the depth of 2 to 7 cm will be preferably employed although depending on the size and sensitivity of the oxygen shortage sensor 14. This is also effective for preventing the intrusion of air C. Namely, the casing of this type may take various forms and no particular limitation of shape is required only if the above-mentioned conditions are satisfied.

In FIG. 8, the oxygen shortage sensor 14 is protected by an insulator 14*a* which is mounted on the casing 15, a lead wire 14*b* being taken out through the insulator 14*a*.

A catalyst may be used above the combustion cylinder 3 in order to purify the combustion exhaust gas. An embodiment including such a catalyst is shown in the sectional view of FIG. 9. An embodiment of a catalyst 60 and the casing 61 is shown in FIG. 10. A leg 62 is mounted under the roof 21 of the housing 1. The casing 61 containing the catalyst 60 and the oxygen shortage sensor 14 is mounted on the leg 62. The catalyst 60 has numerous apertures 60*a* through which the exhaust gas B is passed. Before the catalyst 60, the exhaust gas passes around or through the surroundings of the oxygen shortage sensor 14 thereby to enable the detection of the concentration of oxygen and carbon monoxide. Numeral 63 designates a holder for the oxygen shortage sensor 14 and numeral 4*a* engaging holes for the leg 62.

Figure 9:
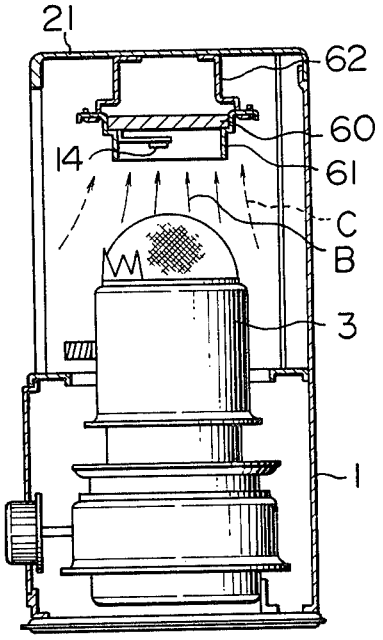
FIG. 9 is a longitudinal sectional view of the burner according to another embodiment of the present invention.
Figure 10:
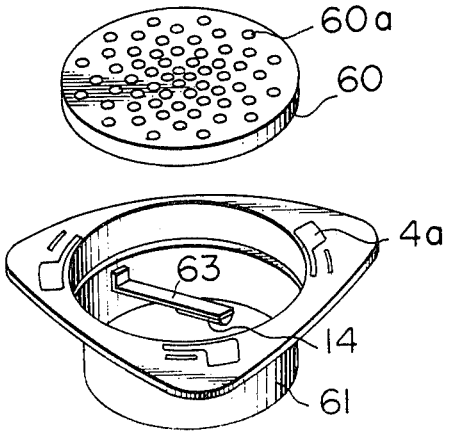
FIG. 10 is an enlarged exploded perspective view of the sensor casing

In this construction, the exhaust gas from the combustion cylinder 3 flows into the casing 61 from the lower opening as shown by the solid arrow B (the air flow shown by the arrow C) in FIG. 9, and after being purified by the catalyst 60, is discharged out of the housing 1 through the leg 62.

In the process, the oxygen shortage sensor 14 detects the concentration of carbon monoxide in the exhaust gas, and when the concentration of the carbon monoxide increases with the decrease of oxygen in a room of insufficient ventilation, namely, when oxygen shortage progresses, the safety device mentioned above is actuated.

Before the actuation of the safety device, the oxygen shortage sensor 14 detects the concentration of carbon monoxide gas which has entered the casing 61 and stays therein, so that the detection signal is subjected to less fluctuations than when the concentration of carbon monoxide gas is directly detected with exhaust gas uprising from the lower portion.

Further, because of the heat received from the catalyst 60, the temperature of the oxygen shortage sensor 14 fluctuates less with the result of very little fluctuation of the detection signal, thus preventing the safety device from being unreasonably actuated.

Now, the casing 15 containing the oxygen shortage sensor 14 will be explained. As seen from FIG. 8, the oxygen shortage sensor 14 is arranged at substantially the center in the casing 15. The wall of the casing 14 is made of a metal material or the like to secure as large a heat capacity as possible.

The casing 15 is used for the purpose of maintaining the oxygen shortage sensor 14 at a constant temperature by the exhaust gas (arrow B) as described above. In spite of the use of the casing 15, however, if air (arrow C) flows in from the periphery of the opening, the ambient temperature of the oxygen shortage sensor 14 may fluctuate thereby causing a false actuation.

Figure 11:
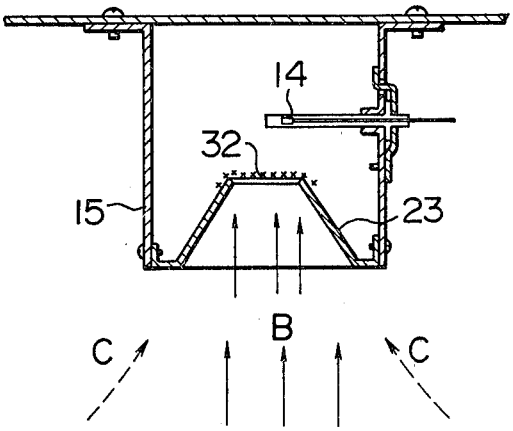
FIG. 11 is a sectional view showing the casing according to another embodiment.

In FIG. 11 showing another embodiment, the oxygen shortage sensor 14 is provided above a baffle member 23 in the shape of a circular truncated cone which is attached to the opening portion on the combustion cylinder side of the casing 15. The diameter of the opening of the cone-shaped baffle member 23 decreases progressively from the combustion cylinder side opening toward the oxygen shortage sensor 14, and a metal wire netting 32 is mounted on the upper opening of the baffle member 23, which netting is one example of a heat insulating porous member. As a result, the exhaust gas that comes up (arrow B) proceeds straight to the baffle member 23 and through the metal netting 32 to reach the oxygen shortage sensor 14. The external air (arrow C), on the other hand, can hardly get into the casing 15 even though it proceeds against the baffle member 23. Thus the temperature of the oxygen shortage sensor 14 substantially remains unchanged but responds only to the exhaust gas.

Figure 12A:
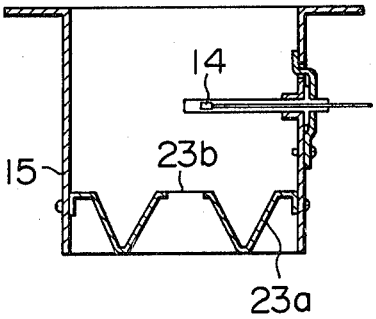
FIG. 12(*a*) is a sectional view of still another embodiment of the casing.
Figure 12B:
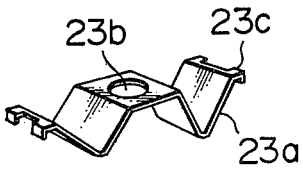

FIGS. 12(*a*) and 12(*b*) show that the oxygen shortage sensor 14 is provided above a W-shaped baffle member 23*a* which is mounted in a rectangular casing 15, and is easily mounted therein as the casing 15 is rectangular in form. Numerals 23*b* and 23*c* designate mounting lugs.

Figure 13A:
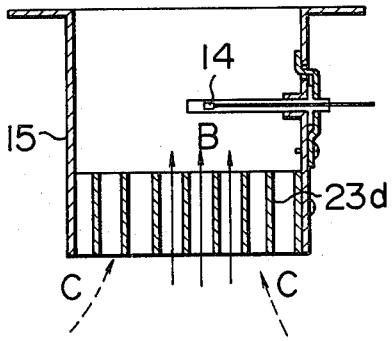
FIG. 13(*a*) is a sectional view showing a further embodiment of the casing.
Figure 13B:
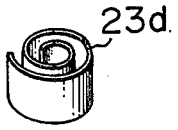

FIGS. 13(*a*) and 13(*b*) show that the oxygen shortage sensor 14 is provided above the another baffle member 23*d* made of a spirally-formed band in the circular cylindrical casing 15. In view of the fact that the baffle member 23*d* is easily fabricated and yet that it is arranged in parallel to the exhaust gas flow (arrow B), the exhaust gas can be brought into direct contact with the oxygen shortage sensor 14 on the one hand and external air C supplied from the peripheral edge area finds it hard to enter the casing 15 as it is blocked by the baffle member 23*d* on the other hand, thus preventing temperature change of the oxygen shortage sensor 14.

Figure 14A:
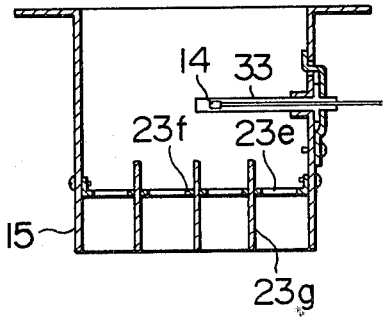
FIG. 14(*a*) is a perspective view showing a still further embodiment of the casing.
Figure 14B:
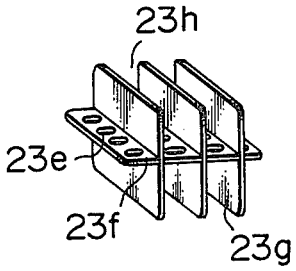

FIGS. 14(*a*) and 14(*b*) show that the oxygen shortage sensor 14 is provided above the baffle member 23*h* made of three vertical boards 23*g* and a plate 23*f* provided with apertures 23*e*, inserted in the rectangular casing 15.

The oxygen shortage sensor 14 is protected by a porcelain type insulator 33, which is in turn mounted on the casing 15.

In this construction, even when the burner unit is open to external atmosphere and is easily cooled by wind or the like, an oxygen shortage can be accurately detected substantially without false actuation.

Figure 15:
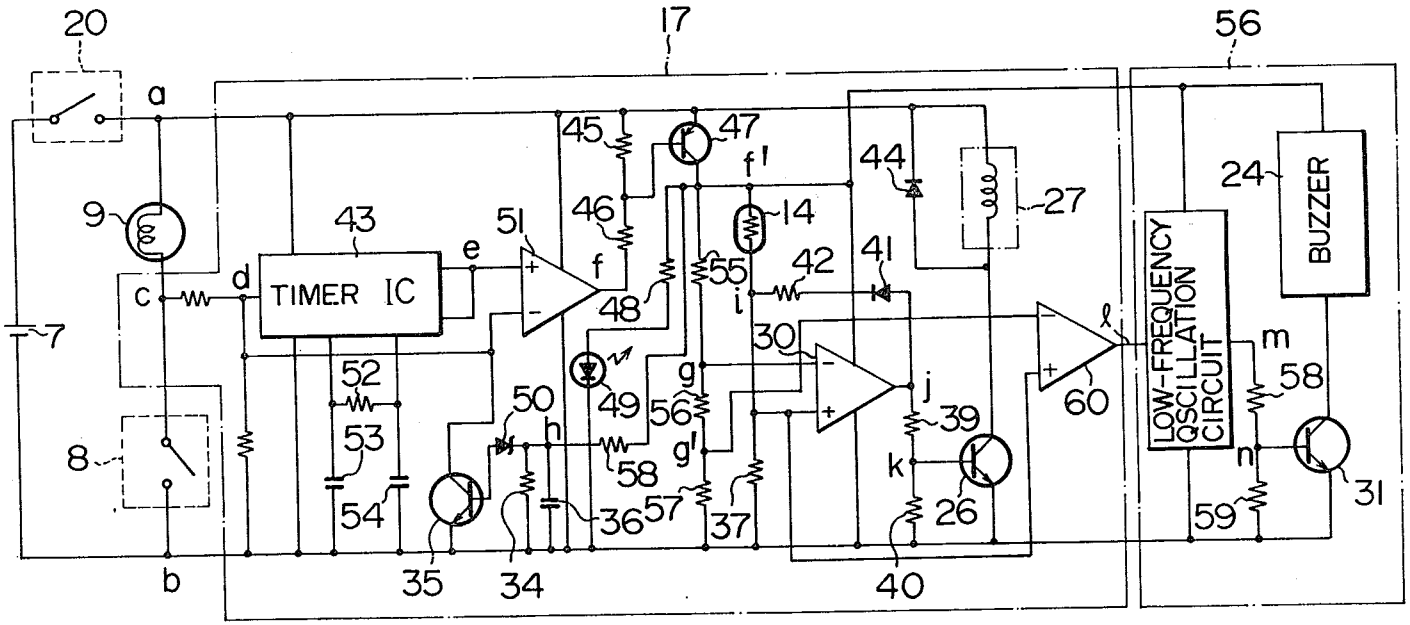
FIG. 15 is a diagram showing an electrical circuit of the control circuit.

A circuit configuration and operation of the control device will be explained. In FIG. 15, the positive terminal of the dry battery 7 is connected through the microswitch 20 to the point a, and the negative terminal thereof is connected to the point b. Across the points a and b are connected a series circuit of the ignition heater 9, point c and ignition switch 8; a power circuit for a timer IC 43, and a power circuit for a differential amplifier (hereinafter referred to as operational amplifier) 51. A current of about 3 mA flows into these circuits if the terminal voltage of the battery 7 is 3 V. An oscillation control resistor 52 for the timer IC 43 is connected between terminals of the timer IC 43, which terminals are connected respectively through a capacitor 53 and a smoothing capacitor 54 to the point b. The output point e of the timer IC 43 is connected to the non-inverting input terminal of the operational amplifier 51, and the point d is connected to the inverting input terminal of the amplifier. The output point f of the operational amplifier 51 is connected to the base of the transistor 47 through the resistors 45 and 46, while the collector f' of the transistor 47 is connected through the resistor 55, point g, resistor 56, point g' and resistor 57 to the point b. The point f' is further connected through the resistor 58, point h and resistor 34 to the point b. The point h is connected to one terminal of the capacitor 36 and connected through the zener diode 50 to the base of the transistor 35. The emitter of the transistor 35 and the other terminal of the capacitor 36 are connected to the point b. The collector of the transistor 35 is connected to the point d. A series connection of the oxygen shortage sensor 14 and point i and resistor 37, power circuit for the operational amplifier 30, a limiting resistor 48 and LED 49 for indicating that the oxygen shortage sensor 14 is in operation are connected in parallel between the points f' and b.

A second operational amplifier 60 is connected with the same power circuit by connecting the inverting (minus) and non-inverting (plus) terminals to the points g' and i respectively. The second operational amplifier 60 produces an output at the point l. An alarm circuit 56 is connected between the points f' and b. The alarm circuit 56 contains a low-frequency oscillator circuit 57 which begins to operate when the output l of the operational amplifier 60 is raised to "high" level. The output terminal m of the low-frequency oscillator circuit 57 is connected through the resistor 58, point n, resistor 59 to the point b. The base and emitter of the transistor 31 are connected to the points n and b respectively. The collector of the transistor 31 is connected to a buzzer 24 as an example of the alarm means.

A series circuit of a resistor 39, point k and resistor 40 is connected between the point j of the operational amplifier 30 and the point b, while a series circuit of a resistor 42 and diode 41 with the anode thereof connected to the point j is connected between the points j and i. The base of the transistor 26 is connected to the point k with the emitter connected to the point b and the collector connected to the point a through the solenoid 27. The solenoid 27 is connected with a diode 44 with the cathode thereof connected to the point a.

In operation, the current of about 3 mA begins to flow when the microswitch 20 is closed by the rotary knob 4. By closing the ignition switch 8, the ignition heater 9 is energized thereby to ignite the wick 6. At the same time, the point c becomes negative, and when the hand is released, it regains the potential of the point a. The point d connected to the reset terminal of the timer IC 43 is actuated at the same time, so that the timer is energized. Before the lapse of a predetermined time, the output point e is maintained "high" as compared with the point d, so that the output f of the operational amplifier 51 is maintained "high". Under this condition, the oxygen shortage sensor 14 is not yet actuated. When the set time of the timer (such as 10 minutes) passes, the signal level of the output point e is reduced to "low" state, the signal level of the output point f of the operational amplifier 51 is reduced to "low" state, transistor 47 is turned on, and the potential of the point f' becomes substantially equal to the potential of the point a. At this time point, the oxygen shortage sensor 14 begins to operate for oxygen shortage detection. On the other hand, electric current flows in the LED 49 through the resistor 48 so that the LED 49 is lit, thus indicating that the oxygen shortage detecting operation by the oxygen shortage sensor 14 is going on.

Assume that the oxygen concentration is reduces. Then the resistance value of the oxygen shortage sensor 14 begins to decrease and the potential at the point i' slowly increases. When this potential exceeds that of the point i, the output point l of the operational amplifier 60 is switched to "high" from "low" state. With the change of the output of the operational amplifier 60 to "high" state, the low-frequency oscillator circuit 57 is activated and begins to oscillate, and the transistor 31 is turned on through the resistors 58 and 59, thus actuating the buzzer 24.

With a further decrease of the oxygen concentration, the potential at the point i increases, and when it exceeds that of the point g, the output j of the operational amplifier 30 is raised to "high" state so that the transistor 26 and hence the solenoid 27 are actuated, and the rotary knob 4 is disengaged, with the result that the wick 6 is lowered sharply to stop the combustion.

In this way, when the oxygen shortage progresses to a certain degree, the buzzer 24 sounds, and when the lack of oxygen is further aggravated, the solenoid 27 is energized thereby to stop the combustion, thus providing dual safety functions.

An intermittent operation of the oxygen shortage circuit will be next explained. Under normal conditions, when the point f' is raised to "high", the capacitor 36 is charged through the line including the resistor 58, point h, and resistor 34. When the point h increases in potential slowly and exceeds the level determined by the zener diode 50, the transistor 35 is turned on.

Since the collector of the transistor 35 is connected to the point d, the timer IC 43 is instantaneously reset on the one hand and the point e is raised to "high" to raise the point f to "high" state to turn off the transistor 47 on the other hand, thus extinguishing the LED 49.

In this manner, the oxygen shortage sensor circuit for the oxygen shortage sensor 14 is disabled in operation for a predetermined length of time in initial stages of combustion, followed by the repetitive turning on and off of the oxygen shortage sensor circuit by the repetitive timer mechanism, so that the oxygen shortage is detected only during the short on-period of the oxygen shortage sensor circuit, and, the off period of the circuit is lengthened to prevent unreasonable consumption of the dry battery 7. Since an oxygen shortage, if any, does not occur in several minutes, the oxygen shortage detection cycles of several to several tens of minutes as shown in the above embodiment poses no practical unfavorable problem, and yet such a detection cycle can realize an extended length of service life.

Further, by addition of the alarm circuit 56 including the low-frequency oscillator circuit 57, the buzzer 24 is operated intermittently, for example, it is turned on for 2 seconds and off for one second at the time of oxygen shortage, thus reducing the consumption of the battery 7 considerably.

It will be understood from the foregoing description that according to the present invention, a casing is provided in a space above the burner unit of the type opened to the outer atmosphere and provided with an opening faced toward the unit, and an oxygen shortage sensor is mounted in the casing in such a way that the heat of exhaust gas rising up from the burner unit stays within the casing, thus stabilizing ambient temperature of the oxygen shortage sensor.

As a result, the oxygen shortage sensor performs the stable operation of oxygen shortage detection , so that at least selected one of the alarming and the stoppage of combustion can be implemented accurately with the detection of an oxygen shortage. A very high safety can be thus secured on the one hand and the alarming or stoppage of combustion is not inconveniently effected when the oxygen is not lacking on the other hand.

We claim:

1. A petroleum burner comprising:

an outer housing containing a fuel tank and having a front opening above said tank;

a wick for sucking up fuel stored in said tank, said wick being able to be moved by operation of a knob between an upper burning position and a lower extinguishing position;

a combustion cylinder, located over said tank and opposite to the front opening portion, for burning fuel evaporated from said wick;

a casing located directly above said combustion cylinder and said wick and attached on a lower surface of a roof plate of said outer housing, said casing having a lower opening;

an oxygen shortage sensor employing tin oxide located in said casing and producing a detecting signal representative of an oxygen shortage;

a baffle member provided in said casing and positioned in said opening for preventing direct intrusion of air from a periphery of said opening of said casing from impinging directly on said oxygen shortage sensor and affecting the detecting signal; and a control unit responsive to said detecting signal for generating a control signal to operate at least one of an external alarm means and a combustion-stopping means in response to said oxygen shortage sensor detecting a shortage of oxygen.

2. A burner according to claim 1, wherein said baffle member is made up of a spirally formed band.

3. A burner according to claim 1, wherein said control unit includes at least two comparators operated in response to different detection signal levels from said oxygen shortage sensor, one comparator operating responsive to a first said detection signal level earlier than the other comparator to energize said alarm means, the other comparator operating responsive to a second said detection signal level later to actuate said combustion stopper means.

* * * * *